US005377983A

United States Patent [19]

Fenton

[11] Patent Number: 5,377,983

[45] Date of Patent: Jan. 3, 1995

[54] FOUR-WAY DIAMOND-CUT SOLE FOR GOLF CLUB HEAD

[75] Inventor: Frank Fenton, Sarasota, Fla.

[73] Assignee: Lisco, Inc., Tampa, Fla.

[21] Appl. No.: 86,396

[22] Filed: Jul. 6, 1993

[51] Int. Cl.[6] ..... A63B 53/04

[52] U.S. Cl. ..... 273/164.1; 273/167 A

[58] Field of Search ..... 273/167 R, 167 A, 167 D, 273/167 E, 167 F, 169, 174, 77 R, 77 A, 164.1, 193 R, 194 R; D21/220

[56] References Cited

U.S. PATENT DOCUMENTS

| | | | |
|---|---|---|---|
| 1,320,163 | 10/1919 | Maurice . | |
| 1,436,579 | 11/1922 | Dayton . | |
| 2,155,830 | 4/1939 | Howard | 273/79 |
| 3,088,736 | 5/1963 | Mospan | 273/167 A X |
| 3,250,536 | 5/1966 | Moser | 273/167 |
| 3,625,518 | 12/1971 | Solheim | 273/175 |
| 3,815,921 | 6/1974 | Turner | 273/167 A X |
| 3,897,065 | 7/1975 | Solheim | 273/167 A |
| 3,961,796 | 6/1976 | Thompson | 273/167 A |
| 3,995,865 | 12/1976 | Cochran et al. | 273/167 F |
| 4,131,607 | 12/1978 | Petit et al. | 260/123.5 |
| 4,325,550 | 4/1982 | Thompson et al. | 273/80 C |
| 4,484,746 | 11/1984 | Brill | 273/167 A |
| 4,519,612 | 5/1985 | Tsao | 273/167 A X |
| 4,607,846 | 8/1986 | Perkins | 273/171 |
| 4,712,798 | 12/1987 | Preato | 273/164.1 |
| 4,854,580 | 8/1989 | Kobayashi | 273/77 A |
| 4,867,457 | 9/1989 | Lowe | 273/164.1 X |
| 4,907,806 | 3/1990 | Antonious . | |
| 4,995,610 | 2/1991 | Paoletti | 273/85 F |
| 5,014,993 | 5/1991 | Antonious | 273/169 |
| 5,042,806 | 8/1991 | Helmstetter | 273/167 A X |
| 5,160,136 | 11/1992 | Eger | 273/77 A |

FOREIGN PATENT DOCUMENTS

| | | | |
|---|---|---|---|
| 160030 | 3/1921 | United Kingdom | 273/167 A |
| 739403 | 10/1955 | United Kingdom | 273/167 A |

*Primary Examiner*—Sebastiano Passaniti

*Attorney, Agent, or Firm*—Donald R. Bahr; John E. Benoit

[57] ABSTRACT

A golf club head having a sole configuration comprising a four-way diamond cut wherein the extremity of the sole is a peak substantially centrally located on the keel of the sole with four adjacent planar surfaces angled upwardly and outwardly toward the body of the club head. The four surfaces form four linear junction lines extending angularly upward away from the peak.

9 Claims, 1 Drawing Sheet

FOUR-WAY DIAMOND-CUT SOLE FOR GOLF CLUB HEAD

This application relates generally to golf club heads and more specifically to the sole configuration of a golf club head.

Golf club heads have been designed with various sole configurations, with the more common sole configuration being of a smooth arcuate line extending from the face of the club to the rear wall of the club.

Some clubs have fairly unique sole configurations designed for various specific functions relating to a particular club. In one configuration the lowest area on the sole is a line extending at least partially along the keel of the club head. Yet another configuration has the lowest area extending along a line transverse to the keel and substantially located along the vertical center line of the face of the club. In either of these cases, the line extends over a substantial part of the sole of the club and, therefore, provides a low area extending either along or transverse to the ground plane as the club is striking the ball.

The golf club head of the present invention is configured so that only one small precise point on the sole of the club contacts the turf, or ground plane, first. This configuration limits the drag from the ground contact and provides additional properties which are desirable in golf club heads.

The object of this invention will become apparent from the following description taken together with the drawings.

SUMMARY OF THE INVENTION

A golf club head is provided having a sole configuration comprising a four-way diamond cut wherein the extremity of the sole is a peak substantially centrally located at a point on the keel of the sole with four adjacent planar surfaces angled upwardly and outwardly from the peak in the direction of the face and rear wall of the club head with the club oriented in the "soled" or address position as shown in FIG. 1. The four surfaces form four linear junction lines extending angularly upward away from the peak.

DETAILED DESCRIPTION OF THE INVENTION

Figure 1:
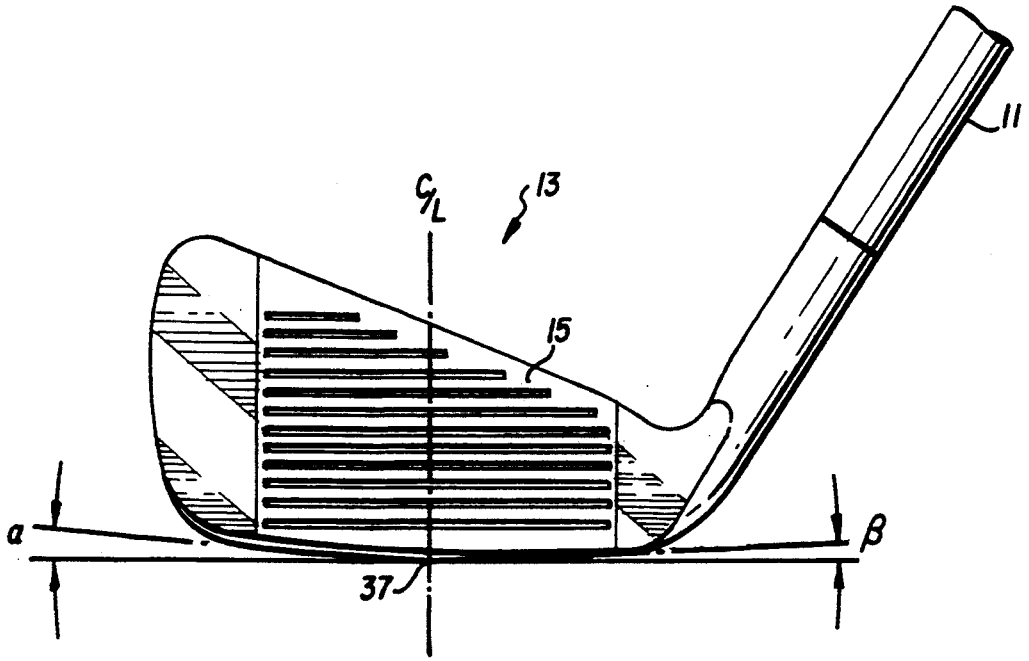
FIG. 1 is a plan view of one golf club head of the present invention.
Figure 2:
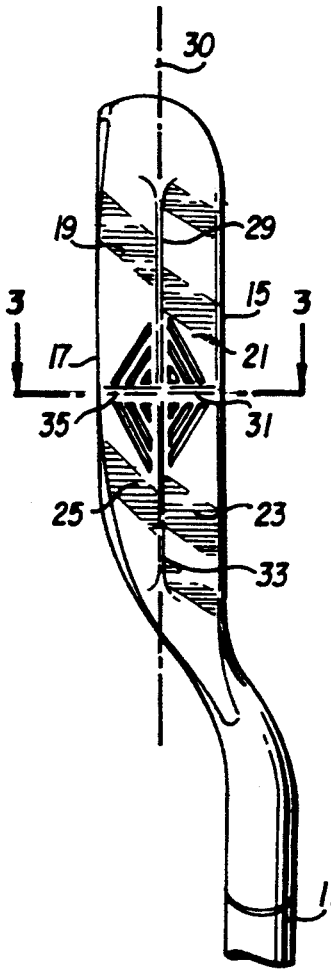
FIG. 2 is a bottom view of the golf club head of FIG. 1.
Figure 3:
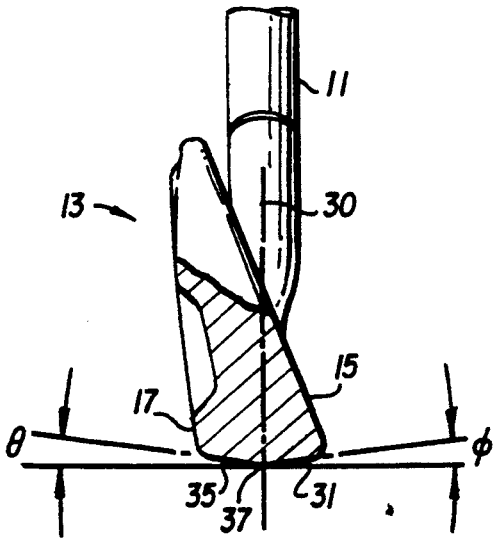
FIG. 3 is a sectional view taken along the lines 3—3 of FIG. 2.

Referring to FIGS. 1, 2, and 3, there is shown, for illustrative purposes, a golf club iron embodying the concept of the present invention. Shaft 11 terminates in head 13 having striking face 15 and rear wall 17. The striking face and rear wall terminate in upper and lower extremities. The keel of the sole extends along the centerline of the sole in a line substantially parallel to the longitudinal centerline 30 of the sole.

The sole of the club as illustrated in FIG. 2 comprises a four-way diamond-cut configuration which includes upwardly angularly extending faces 19, 21, 23, and 25, all of which are substantially planar. These faces meet so as to form linear junction lines 29, 31, 33, and 35, with the junction lines meeting. As can be seen from FIGS. 1 and 3, peak 37 defines a point at the extremity of the sole of the golf club and linear junction lines 29, 31, 33, and 35 extend angularly upward from the peak to the lower extremities of the striking face and rear wall.

Linear junction lines 29 and 33 extend angularly upward in opposite directions from peak 37 along the keel of the golf club head. Linear junction lines 31 and 35 extend in opposite directions substantially transverse to junction lines 29 and 33 and also extend angularly upward from peak 37. Referring to FIG. 1, linear junction line 29 forms an angle $\alpha$ with ground plane 39 extending through peak 37, while linear junction line 33 forms an angle $\beta$ relative to the ground plane. The ground plane in the present illustration is defined as a plane which is substantially perpendicular to a plane passing through the vertical centerline C/L of the club head (when the club head is in the address position shown in FIG. 1) and passes through peak 37. For most clubs the centerline preferably passes through peak 37; however, for some clubs, such as wedges, the peak does not lie on the centerline.

Referring to FIG. 3, linear junction line 31 forms an angle $\phi$ relative to ground plane 39 while linear junction line 35 forms an angle $\theta$ with ground plane 39. As shown, when the club is in the address position, plane 30, which passes through the longitudinal axis 30 of shaft 11, also passes through peak 37.

Since the four planar surfaces meet at the linear junction lines, it will become obvious that the angle of the linear junction lines determines the angle of the planar surfaces extending away from peak 37.

It is preferable that the angles $\alpha$ and $\beta$ be between 3° and 10° and the angles $\phi$ and $\theta$ be between 5° and 20°. In most instances the angles $\alpha$ and $\beta$ will be substantially identical and the angles $\phi$ and $\theta$ will be substantially identical; however, such a relationship is not necessary in order to obtain the desired peak at the extremity of the sole. Thus, as illustrated in FIG. 1, angles $\alpha$ and $\beta$ may be different.

In one example of a club head iron the values of these angles were as follows:

$\alpha = 5°$
$\beta = 5°$
$\phi = 10°$
$\theta = 10°$

The particular sole structure of the present invention allows only one small precise point on the sole of the club to always contact the turf first. This limits the drag from the ground contact always experienced when a club strikes the ground. Additionally, this type of sole has an advantage in that the front edge of the sole has a "bounce" angle (i.e., not a steep, digging, leading edge) and the rear of the sole is angled up to keep the club from "rolling" in address.

One further advantage is that the sole of the present invention allows the golfer to sole the club with a flatter or more upright lie, depending upon the type of shot called for relative to the terrain on which is ball is lying.

Variations of the particular sole structure of the present invention may be used without departing from the invention, the scope of which is to be limited only by the following claims.

I claim:

1. A golf club head having a striking face including upper and lower extremities, a rear wall having upper and lower extremities, a heel, a toe and a sole comprising a peak on said sole, said peak defining a point on said sole; and four substantially planar surfaces extending angularly from said peak on said sole and forming first, second, third, and fourth substantially linear junction lines extending angularly from said peak;

two of said planar surfaces terminating at said lower extremity of said striking face of said club and two of said planar surfaces terminating at said lower extremity of said rear wall of said club.

2. The golf club head of claim 1 wherein said peak is located at substantially the center of said sole.

3. The golf club head of claim 2 wherein said first and third linear junction lines lie in a first plane extending along a centerline from said heel to said toe of said golf club head; and said second and fourth linear junction lines lie in a second plane substantially perpendicular to said first plane.

4. The golf club head of claim 3 wherein said first and third linear junction lines extend upward in opposite directions at an angle relative to a ground plane extending perpendicular to a plane passing through the vertical centerline of said club head; and said second and fourth linear junction lines extend in opposite directions at an angle relative to said ground plane.

5. The golf club head of claim 4 wherein said angle of each of said first and third linear junction lines is between 3° and 10°.

6. The golf club head of claim 4 wherein said angle of each of said second and fourth linear junction lines is between 5° and 20°.

7. The golf club head of claim 4 wherein said angle of each of said first and third linear junction lines is substantially 5°.

8. The golf club head of claim 4 wherein said angle of each of said second and fourth junction lines is substantially 10°.

9. A golf club head having a striking face having an upper and lower extremity, a rear wall having an upper and lower extremity, a head, a toe and a sole, said sole comprising a peak, said peak defining a point on said sole; and a plurality of adjacent substantially planar surfaces extending angularly from said peak on said sole, said planar surfaces forming substantially linear junction lines between adjacent surfaces, said junction lines extending selectively from said peak to said lower extremities of said striking face and said rear wall.

* * * * *